United States Patent [19]

Ott

[11] 4,004,094

[45] Jan. 18, 1977

[54] ENCLOSURE SYSTEM FOR SOUND GENERATORS

[75] Inventor: James H. Ott, Akron, Ohio

[73] Assignee: Novar Electronics Corporation, Barberton, Ohio

[22] Filed: Mar. 16, 1976

[21] Appl. No.: 667,351

[52] U.S. Cl. ..... 179/1 E; 181/151

[51] Int. Cl.[2] ..... H04R 1/02

[58] Field of Search ..... 179/1 E; 181/146, 148, 181/151, 166

[56] References Cited

UNITED STATES PATENTS 2,115,129 4/1938 Thienhaus ..... 179/1 E

FOREIGN PATENTS OR APPLICATIONS 111,477 7/1965 Netherlands ..... 179/1 E

*Primary Examiner*—George G. Stellar
*Attorney, Agent, or Firm*—Frank H. Foster

[57] ABSTRACT

A device for use in an enclosure associated with an audio speaker or other sound producing device and which permits relatively large volume changes within the enclosure as a result of relatively small pressure changes so that relatively small enclosures can be as effective as enclosures of larger volume. The device reduces the energy required from the speaker to change the volume of the interior of the enclosure. The device has a displaceable walled container having an expansible and contractible volume containing a composition of matter at gas phase/liquid phase equilibrium at its boiling point under atmospheric or other ambient pressure. The composition of matter preferably selected is one having the characteristic that relatively large volumes undergo a phase change for relatively small energies. The composition is heated to its boiling point. The heater is actuated by a volume responsive switch to maintain the container within a selected range of volume. Pressure perturbations caused by movement of the vibratorily driven membrane of the sound producing device cause alternate condensation and vaporization of the composition of matter to minimize backpressure.

8 Claims, 3 Drawing Figures

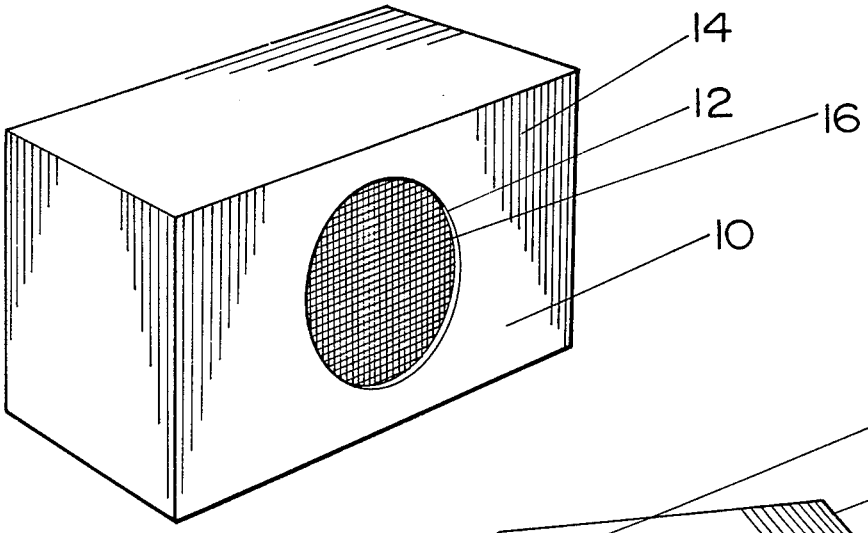
Fig. 1
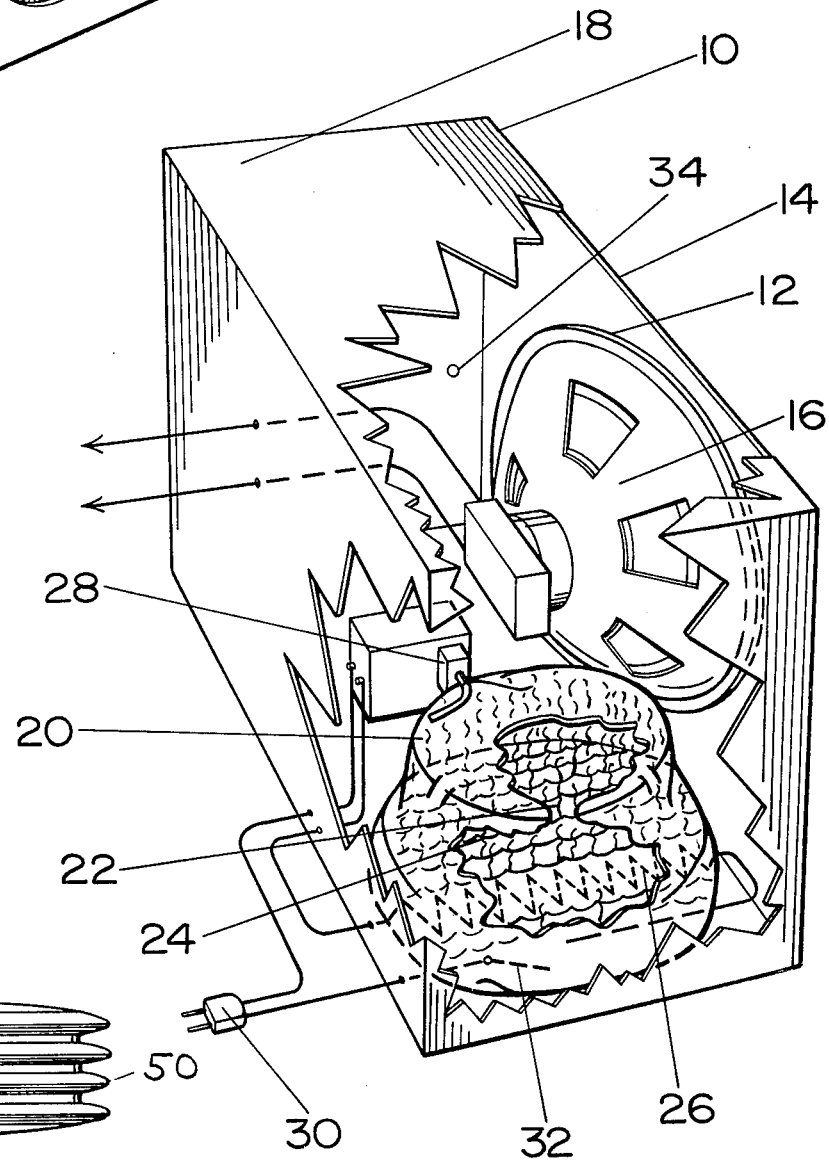
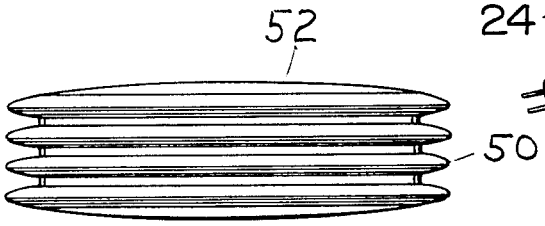
Fig. 3
Fig. 2

ENCLOSURE SYSTEM FOR SOUND GENERATORS

BACKGROUND OF THE INVENTION

This invention relates to enclosure systems for vibratorily driven, sound producing membranes and more particularly relates to a system for minimizing the effect of backwaves generated by such vibrating membranes.

Various sound producing generators such as audio speakers and other audio transducers as well as industrial sound annunciators, such as horns and buzzers, operate by driving a membrane in physical vibrations. The vibrating membrane radiates oppositely directed waves consisting of alternate regions of increased and decreased pressure. Unfortunately, these frontwaves and backwaves can be transmitted through the air to intersect and cause interference, particularly destructive interference.

The conventional approach toward the solution of this problem has been to mount the vibratorily driven membrane at a port provided in the wall of an enclosure. The enclosure is then designed either to eliminate the backwaves by absorbing their energy within the enclosure or to direct the backwaves through passageways and baffles and then transmitting them out of the enclosure in a manner intended to provide only constructive interference with the frontwaves.

One problem with the first mentioned solution is that a substantial amount of energy which is required to drive the vibrating membrane is wasted by subsequent absorbtion in the enclosure. Another problem which increases as a speaker and enclosure becomes smaller is that substantial back pressures are exerted against the vibrating membrane by the gas, usually air, within the enclosure. The back pressure retards the movement of the membrane.

A problem with the second described reflex system is that they are frequency responsive and consequently constructive interference cannot be uniformly maintained over the broad spectrum of audio frequencies.

There is, therefore, a need for an enclosure system for use with vibratorily driven membranes which can dissipate or destroy the backwaves without significant pressure variations within the enclosure in order to minimize the speaker input energy required to overcome these backwaves.

SUMMARY AND OBJECTS OF THE INVENTION

It is a primary object of the present invention to provide an enclosure system for a sound generator which can neutralize the backwaves from a vibratorily driven membrane and minimize the work energy which the vibratory membrane must apply to the enclosure system.

Another object and feature of the present invention is to provide an enclosure system for vibratorily driven membranes which can be substantially smaller in volume and yet perform as effectively as considerably larger conventional enclosure systems.

The invention includes a device positioned within an enclosure for a vibratorily driven membrane for providing a relatively large ratio of volume change to pressure change within the enclosure. The device is a displaceable-walled container having an expansible and contractible volume and containing a composition of matter at an equilibrium state between its gas phase and another phase.

Further objects and features of the invention will be apparent from the following specification and claims when considered in connection with the accompanying drawings illustrating the preferred embodiment of the invention.

DESCRIPTION OF THE DRAWINGS

FIG. 1 is a view in perspective of the exterior of a speaker enclosure.

FIG. 2 is a view in vertical section of a speaker enclosure embodying the present invention.

FIG. 3 is a view of an alternative container for use in embodiments of the invention.

In describing the preferred embodiments of the invention illustrating in the drawings, specific terminology will be resorted to for the sake of clarity. However, it is not intended to be limited to the specific terms so selected and it is to be understood that each specific term includes all technical equivalents which operate in a similar manner to accomplish a similar purpose.

DETAILED DESCRIPTION

FIG. 1 illustrates a speaker enclosure 10 which ordinarily is an attractive cabinet and which has a port 12 formed in its front wall 14. A conventional audio speaker which includes its vibratorily driven membrane 16, conventionally of conical configuration, is mounted at the port 12.

FIG. 2 illustrates the interior space 18 defined by the walls of the enclosure 10 and the vibratorily driven membrane 16.

A flexibly walled container 20 is mounted within the interior space 18 and has an expansible and contractible volume. The flexibly walled container 20 may, for example, consist of a sealed, impervious sack constructed of polyethelene film. However, it should be understood that a great variety of materials and container configurations may be utilized. FIG. 3, for example, illustrates one having pleated folds 50 and diaphragm surface 52 and capable of expanding and contracting in volume. The vibratorily driven membrane itself might be impervious and form a wall of the flexibly walled container.

A composition of matter is contained within the container 20 and has an equilibrium state between a gas phase 22 and another phase 24. In the preferred embodiment of the invention a composition of matter is selected which has certain characteristics which are advantageous operating according to the present invention. A composition of matter is preferably selected which has a boiling point at atmospheric pressure which is slightly above the ambient temperature of the expected enclosure environment which is usually the temperature of the human environment. The material is one which easily condenses and vaporizes large gaseous volumes. I have found that materials which meet these desired characteristics most advantageously are the halogenated hydrocarbons having a fluourine atom and commonly known under the trade name Freon. For example, F113 having the chemical formula $C_2Cl_3F_3$ has a boiling point at approximately 117° F and a heat of vaporization of approximately 35 calories per gram. Similarly, F114B2 having the chemical formula of $C_2Br_2F_4$ has a similar boiling point and an estimated heat of vaporization of 25 calories per gram. Other material such as an ether may also be useful.

Preferably, the composition of matter which is selected is placed into the container 20 in a liquid form and all foreign matter or gas is exhausted from the container before it is sealed. In this manner, it is assured that the entirety of the composition of matter will be in its liquid phase at temperatures below its boiling point.

A resistance heater 26 is mounted in close proximity or alternatively even within the container 20. An electrical switch 28, such as a conventional microswitch, is mounted within the interior space 18 and is connected to an energy source connector 30 in such a manner that the application of force upon the switch 28 by the exterior of the container 20 opens the switch and the switch is closed when an insufficient force is applied on the switch by the exterior wall of the container 20. In this manner, the switch is opened to deenergize the heater 26 at a maximum volume of the container 20 and the switch is closed when the container 20 volume falls below a minimum volume to energize the heater.

The operation of the embodiment of FIG. 2 may be initially considered by assuming that the apparatus has been unused and has been resting at ambient temperature and atmospheric pressure. Under these conditions, with a composition of matter selected to have a boiling point above normal ambient temperatures of the human environment, the container 20 will be collapsed and have a relatively small volume containing only liquid phase.

When the apparatus is energized such as by the closure of a manual switch 32 or similar automatic means, the heater 20 will begin warming up the liquid 24 to higher temperatures until it reaches its boiling point. Thereafter, further heat added to the system will cause the vaporization of the composition of matter so that a substantial body of vapor phase will be eventually formed. When the volume of the container 20 is increased sufficiently due to the formation of the vapor phase, the switch 28 will be opened by the force of the container wall and heat will no longer be added to the system. Of course, as heat is slowly lost from the system, the container will slowly shrink in volume until the switch 28 is again closed to again put further heat energy into the system to create more vapor phase. Therefore, in steady state operation there will be relatively slow and minor variations in the entire volume of the container 20 but, most importantly, the liquid 24 and vapor phase 22 will be maintained at an equilibrium at the boiling temperature of the composition of matter. This condition may be considered as the operating point of the system about which perturbations will be induced by movements of the vibratorily driven membrane 16.

The forward and backward oscillatory movements of the membrane 16 will induce small pressure variation perturbations within the exterior space 16. For example, for those half cycles which drive the membrane 16 in a forward direction, a reduced pressure will be generated within the interior space 18. This reduced pressure will similarly reduce the pressure upon the composition of matter within the container 20. The result will be a lowering of the effective boiling point of the composition of matter and consequently an increase in its vaporization tending toward a new equilibrium at ambient pressure. Similarly, the half cycles which move the membrane 16 backwardly into the interior space 18 will momentarily increase the pressure within the interior space. This will raise the effective boiling point of the composition of matter in the container 20 and cause condensation of the gas phase 22 in movement of the system toward a new equilibrium.

Consequently, as the speaker diaphragm moves backwardly or forwardly, it causes a pressure increase or decrease in the enclosure. This pressure change causes evaporation or condensation of the composition of matter which causes the pressure change to be reduced and the temperature of the composition of matter at the phase interfaces to be increased or decreased as a result of the condensation or evaporation. Therefore pressure changes are being converted to temperature changes so that the amplitude of the pressure change is minimized.

The result, therefore, is that forward and rearward movements of the membrane 16, which tend to increase or decrease the volume of the interior space 18, are compensated for by the vaporization or condensation of the composition of matter. Consequently, an increased volume within the enclosure due to forward movement of the membrane is filled by additional vapor and a decreased volume is compensated by a decreased volume of the container resulting from the condensation of vapor molecules.

Since vaporization is endothermic and condensation is exothermic, the oscillations of the membrane 16 will tend to cause minor perturbations of the temperature of the composition of matter within the container 20. However, because of the characteristics of the composition of matter which is selected, the quantity of this energy is desirably quite small although the concept of the invention also applies to less effective compositions of matter. Consequently, a greater portion of energy used to drive the membrane 16 is converted to useful sound radiated as forward waves while the backwaves are reduced or nullified by the vaporization and condensation of the composition of matter. The volume displacement caused by the membrane 16 is compensated for by a compensating volume displacement of the container 20 without requiring appreciable energy to do the work of causing the volume changes within the container 20.

The preferred criterion for selecting the most desirable composition of matter is believed to be the product of the heat of vaporization times the molecular weight of the composition. The lower this product the more effective the composition. The reasoning for this is as follows.

I wish to obtain the most volume change per unit of energy. Said another way we wish to require the least energy to get a volume change. Therefore we wish to maximize the ratio of volume change/energy or minimize energy/volume.

Heat of vaporization and heat of condensation represent the energy per unit of Mass of the phase change. For the present invention, it is the energy per unit of volume which is relevant.

However from Avogadro's Law it is known that equal volumes of all gases at the same temperature and pressure all contain the same number of molecules.

Therefore the ratio of volume/energy is proportional to the ratio of molecules/energy and the reciprocal of these ratios are proportional. In words this means that the desired composition requires a relatively low energy to get a molecule from the liquid phase across the interface into the vapor phase. Or stated inversely, a unit of energy should convert a relatively large number of molecules into the gas phase.

The molecular weight of a composition is its relative mass per volume or relative mass/volume or relative mass/molecule.

Therefore if the heat of Vaporization $H_{vp}$ in units of energy/mass is multiplied by the molecular weight in units of mass/volume the product is a ratio in units of energy/volume. This product is, therefore, the criterion which is desirably minimized for most effective operation of a composition according to the present invention.

As with most physical systems, various design parameters need to be considered and may in some instances need to be compromised by design tradeoffs.

For example, it is of course necessary that the volume of gas phase 22 be at least equal to the maximum volume displacement of the membrane 16. It is further desirable and increasingly efficient if the container 20 be made to occupy the largest possible proportion of the entire interior space 18. It is further desirable to maximize the liquid/gas phase interface area in order to facilitate the movement of molecules between the liquid phase and gas phase during condensation and vaporization.

It is also desirable to provide a very small secondary hole 34 in the enclosure 10 so that, during the initial expansion of the composition of matter from an entirely liquid phase to an equilibrium phase, some of the air within the enclosure 10 may be displaced. However, this opening 34 is made small enough that its effects are otherwise negligible during operation.

Of course, it would also be desirable to make the interior space as large as possible. The advantage of the invention, however, is that a smaller interior space with the present invention can operate as effectively as a conventional enclosure of considerably greater volume.

There are other inferior alternatives, embodying the concepts of the present invention. For example, if a composition of matter is utilized having a boiling point below the normal ambient temperature of the human environment a refrigerating system could be used in a similar manner to maintain the composition of the matter at its boiling point equilibrium. Consequently, it should be understood that "heat transferring means" which add heat or remove heat to or from a system are contemplated within the present invention. Thus heat transferring means is not limited to transfer of neat energy from one place to another but rather includes any system which changes the heat content of the composition of matter.

While a flexibly walled container is preferred for the composition of matter, other displaceable wall containers may also be used. For example a piston of low mass may form a wall and be slidably mounted in a cylinder.

Furthermore the sensing means which is controllably connected to the heater or other heat transferring means could indirectly maintain the desired average container volume by sensing such things as temperature, liquid level, etc.

It may also be desirable to increase the surface area available in the gas phase portion of the container in order to provide sites upon which condensation can occur and to which the condensate can adhere so that it can more readily evaporate. This may be done by roughening the inner surface of the container or by adding an interior structure such as steel wool.

Additionally a material with a high specific heat may be used as part of the container wall or adjacent to it to minimize temperature variations in the composition of matter.

It should further be noted that if another material such as air is included within the flexibly walled container, then a dissolved vapor and liquid phase equilibrium will exist at temperatures below the boiling point temperature. In such systems, perturbations of pressure will tend to drive the system toward a new equilibrium and, consequently, it will behave somewhat in the manner of the present invention. Such a system with a foreign gas could be operated at its boiling point equilibrium. While such systems will operate with evaporation and condensation they will do so with less effectiveness and efficiency.

It might further be noted that some compositions of matter are capable of an equilibrium between a solid phase and a vapor phase. The vaporization of a material from a solid phase is known as sublimation and such a material which consumes or gives off low energy during vaporization or solidification could operate according to the teaching of the present invention.

It should further be understood that the present invention also contemplates the compensation of volume changes or neutralization of pressure changes which may occur at sub-sonic or supersonic frequencies.

It is to be understood that while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims.

I claim:

1. An improved sound production apparatus of the type having a less than perfectly sealed enclosure with an interior space and a port formed in a wall thereof and having a vibratorily driven membrane mounted at said port, wherein the improvement comprises a displaceable-walled container formed within said interior space, said container having an expansible and contractable volume and containing a composition of matter having an equilibrium state between a gas phase and another phase, said composition of matter has an average gas/liquid phase equilibrium at atmospheric pressure and wherein there is further provided a heat transferring means including a sensing means and a control means for maintaining said composition of matter at an equilibrium wherein there is a substantial volume of gas phase which is greater than the maximum volume displacement of said membrane.

2. An apparatus according to claim 1 wherein said sensing means is a volume responsive switch means, wherein said heat transferring means and control means include a heater means which is energized by the switch means at a selected minimum volume and deenergized at a selected maximum volume and wherein said composition of matter has a boiling temperature at atmospheric pressure above the preferred temperature range of the human environment.

3. An apparatus according to claim 2 wherein said composition of matter has a relatively low product of heat of vaporization and molecular weight.

4. An apparatus according to claim 2 wherein said composition of matter is a refrigerant.

5. An apparatus according to claim 2 wherein said composition of matter comprises a halogenated hydrocarbon.

6. An apparatus according to claim 5 wherein said composition of matter is selected from a group consisting of $C_2Cl_3F_3$ and $C_2Br_2F_4$.

7. An apparatus according to claim 2 wherein a surface-increasing structure is mounted in said container for within said vapor phase.

8. An apparatus according to claim 2 wherein at least a portion of said container is formed of a material having a high specific heat.

* * * * *